US012759673B2

(12) United States Patent
Wang et al.

(10) Patent No.: US 12,759,673 B2
(45) Date of Patent: Oct. 13, 2026

(54) HIGH-STABILITY DEEP-SEA BUOY PLATFORM AND AN OSCILLATION CONTROL METHOD THEREOF

(71) Applicant: INSTITUTE OF OCEANOGRAPHIC INSTRUMENTATION, SHANDONG ACADEMY OF SCIENCES, Qingdao (CN)

(72) Inventors: Juncheng Wang, Qingdao (CN); Shixuan Liu, Qingdao (CN); Jiming Zhang, Qingdao (CN); Shizhe Chen, Qingdao (CN); Yunzhou Li, Qingdao (CN); Xiao Fu, Qingdao (CN); Yuzhe Xu, Qingdao (CN); Shanshan Zheng, Qingdao (CN); Zhuo Lei, Qingdao (CN); Wenqing Li, Qingdao (CN); Miaomiao Song, Qingdao (CN)

(73) Assignee: INSTITUTE OF OCEANOGRAPHIC INSTRUMENTATION, SHANDONG ACADEMY OF SCIENCES, Qingdao (CN)

( * ) Notice: Subject to any disclaimer, the term of this patent is extended or adjusted under 35 U.S.C. 154(b) by 216 days.

(21) Appl. No.: 18/814,572

(22) Filed: Aug. 25, 2024

(65) Prior Publication Data

US 2025/0074551 A1 Mar. 6, 2025

(51) Int. Cl.

| | |
|---|---|
| ***B63B 22/20*** | (2006.01) |
| ***B63B 22/00*** | (2006.01) |
| ***B63B 35/44*** | (2006.01) |

(52) U.S. Cl.

CPC ..... *B63B 22/20* (2013.01); *B63B 2022/006* (2013.01)

(58) Field of Classification Search

CPC .... B63B 22/20; B63B 2022/006; B63B 35/44
See application file for complete search history.

(56) References Cited

U.S. PATENT DOCUMENTS

| | | | | |
|---|---|---|---|---|
| 6,425,710 | B1 * | 7/2002 | Khachaturian | B63B 1/14 405/206 |
| 2004/0037651 | A1 * | 2/2004 | Khachaturian | B63B 1/14 405/203 |
| 2005/0281624 | A1 * | 12/2005 | Basak | B63B 35/44 405/195.1 |

FOREIGN PATENT DOCUMENTS

| | | | |
|---|---|---|---|
| CN | 105253255 | A | 1/2016 |
| CN | 217396762 | U | 9/2022 |
| CN | 115520335 | A | 12/2022 |

* cited by examiner

*Primary Examiner* — Stephen P Avila
(74) *Attorney, Agent, or Firm* — Jiwen Chen; Joywin IP Law PLLC

(57) ABSTRACT

The present invention provides a high-stability deep-sea buoy platform including a mast tube housing an attitude sensor used to monitor the tilt angle of the deep-sea buoy platform; a plurality of buoyancy tubes symmetrically and equally spaced around the mast tube; the buoyancy tube includes an elastic float and a water tank; the cross-section of the elastic float is ring-shaped; the elastic float being fitted around the outer side of the upper part of the water tank; the water tank is cylindrical and the interior of the water tank is divided into an upper layer and a lower layer, and the lower layer containing ballast water; each water tank is connected to the other water tanks via pipelines, each of the pipelines equipped with a flow valve; and a damping plate is horizontally connected between the bottoms of adjacent water tanks. The present invention provides strong resistance to wind, waves and currents, minimal oscillation, and high stability, making it suitable for use in complex and harsh deep-sea environments.

4 Claims, 6 Drawing Sheets

HIGH-STABILITY DEEP-SEA BUOY PLATFORM AND AN OSCILLATION CONTROL METHOD THEREOF

This application claims priority of Chinese Application No. 202311107948.2, Aug. 31, 2023, which is hereby incorporated by reference.

TECHNICAL FIELD

The present invention relates to the field of marine observation technology, specifically to a high-stability deep-sea buoy platform and an oscillation control method thereof.

BACKGROUND TECHNOLOGY

Marine environmental observation information is of great significance for marine safety assurance, marine environmental monitoring and forecasting, and the study of air-sea interactions. Marine buoys are important equipment for achieving automatic marine environmental observations, and the buoy carriers are mainly in the form of discs.

Currently, marine buoys used for environmental observation typically have diameters ranging from about 3 meters to 10 meters. Buoys with diameters around 3 meters and 6 meters are relatively lightweight and can be moored using light anchor systems such as ropes, making them suitable for deployment in deep seas of several thousand meters. However, due to their small diameter, these buoys have limited load capacity and power supply capability, making it difficult to carry high-power, large-volume equipment. Their ability to withstand harsh sea conditions is also poor. Large disc-shaped buoys with diameters around 10 meters and 15 meters have strong adaptability to harsh marine environments, as well as strong load capacity and resistance to damage. However, their large weight necessitates the use of heavy anchor systems, which makes them unsuitable for deep-sea deployment beyond 200 meters.

Additionally, traditional disc-shaped buoys tend to have significant oscillation angles in windy and wavy conditions, which affects the measurement accuracy of profile winds and ocean currents, making it difficult to meet the stability requirements for deep-sea marine observations.

Therefore, there is an urgent need for a highly stable buoy to meet the demands of deep-sea marine observation.

SUMMARY OF THE INVENTION

The object of this invention is to provide a high-stability deep-sea buoy platform and an oscillation control method thereof. The buoy platform has strong resistance to wind and waves, exhibits minimal oscillation, and possesses high stability, making it suitable for use in complex and harsh deep-sea environments.

Therefore, the present invention provides a high-stability deep-sea buoy platform, which includes: a mast tube housing an attitude sensor used to monitor the tilt angle of the deep-sea buoy platform; a plurality of buoyancy tubes symmetrically and equally spaced around the mast tube; the buoyancy tube includes an elastic float and a water tank; the cross-section of the elastic float is ring-shaped; the elastic float being fitted around the outer side of the upper part of the water tank; the water tank is cylindrical and the interior of the water tank is divided into an upper layer and a lower layer, and the lower layer containing ballast water; each water tank is connected to the other water tanks via pipelines, each of the pipelines equipped with a flow valve; and a damping plate is horizontally connected between the bottoms of adjacent water tanks.

Preferably, it further includes: a control system, which is used to control the valve opening of the flow valve based on the tilt angle of the deep-sea buoy platform monitored by the attitude sensor.

Preferably, in a vertical stationary state, the volume of ballast water in the water tank is less than or equal to half of the volume of the water tank.

Preferably, the number of buoyancy tubes is four and corresponding numbers of elastic floats and water tanks is four; each water tank is connected to the other three water tanks via the pipelines.

Preferably, the pipelines include four first pipelines forming a square, and two vertical and connected second pipelines; the first pipelines are used to connect two water tanks on the same side, and the second pipelines are used to connect two water tanks on opposite corners.

Preferably, a connection chamber is located at the intersection of the two second pipelines; the connection chamber is connected to the four water tanks via the two second pipelines.

Preferably, it further includes a connecting frame, and the connecting frame is used to connect the four buoyancy tubes and to connect the four buoyancy tubes to the mast tube.

Preferably, the connecting frame is composed of a plurality of hollow connecting pipes; and cables are allowed to pass through the connecting pipes.

Preferably, the inner diameter of the elastic float is equal to the outer diameter of the water tank; and the elastic float provides buoyancy and collision protection.

The present invention also provides an oscillation control method for the high-stability deep-sea buoy platform, which includes the following steps: a side where two water tanks on the same edge are located is defined as a first side, and a side corresponding to the first side where the other two water tanks are located is defined as a second side; a first stage: the deep-sea buoy platform sways from a vertical stationary state to a titled position on the first side; the ballast water in the two water tanks on the second side flows through the pipelines into the two water tanks on the first side in a tilted manner; when the attitude sensor detects an increase in the tilt angle of the deep-sea buoy platform, it sends a signal to the control system; the control system reduces the opening of the flow valves, decreasing the volume and speed of the ballast water flowing through the pipelines; a second stage: the deep-sea buoy platform sways back from the maximum tilt angle towards the second side to a vertical state; the ballast water inside the two water tanks on the second side flows through the pipelines towards the two water tank on the first side in a titled manner; when the attitude sensor detects a decrease in the tilt angle of the deep-sea buoy platform, it sends a signal to the control system; the control system increases the opening of the flow valves, increasing the volume and speed of the ballast water flowing through the pipelines; a third stage: the deep-sea buoy platform sways from a vertical stationary state to a titled position on the second side; the ballast water in the two water tanks on the first side flows through the pipelines into the two water tanks on the second side in a tilted manner; when the attitude sensor detects an increase in the tilt angle of the deep-sea buoy platform, it sends a signal to the control system; the control system reduces the opening of the flow valves, decreasing the volume and speed of the ballast water flowing through the pipelines; a fourth stage: the deep-sea buoy platform sways back from the maximum tilt angle towards the first side to a vertical state; the ballast water inside the two water tanks on the first side flows through the pipelines towards the two water tank on the second side in a titled manner; when the attitude sensor detects a decrease in the tilt angle of the deep-sea buoy platform, it sends a signal to the control system; the control system increases the opening of the flow valves, increasing the volume and speed of the ballast water flowing through the pipelines.

Compared with the prior art, the advantages and positive effects of the invention are: the high-stability deep-sea buoy platform includes a mast tube housing an attitude sensor used to monitor the tilt angle of the deep-sea buoy platform; a plurality of buoyancy tubes symmetrically and equally spaced around the mast tube; the buoyancy tube includes an elastic float and a water tank; the cross-section of the elastic float is ring-shaped; the elastic float being fitted around the outer side of the upper part of the water tank; the water tank is cylindrical and the interior of the water tank is divided into an upper layer and a lower layer, and the lower layer containing ballast water; each water tank is connected to the other water tanks via pipelines, each of the pipelines equipped with a flow valve; and a damping plate is horizontally connected between the bottoms of adjacent water tanks. The present invention provides strong resistance to wind, waves and currents, minimal oscillation, and high stability, making it suitable for use in complex and harsh deep-sea environments.

Other features and advantages of the invention will become clearer after reading the detailed description in conjunction with the accompanying drawings.

DETAILED DESCRIPTION OF THE EMBODIMENTS

Figure 1:
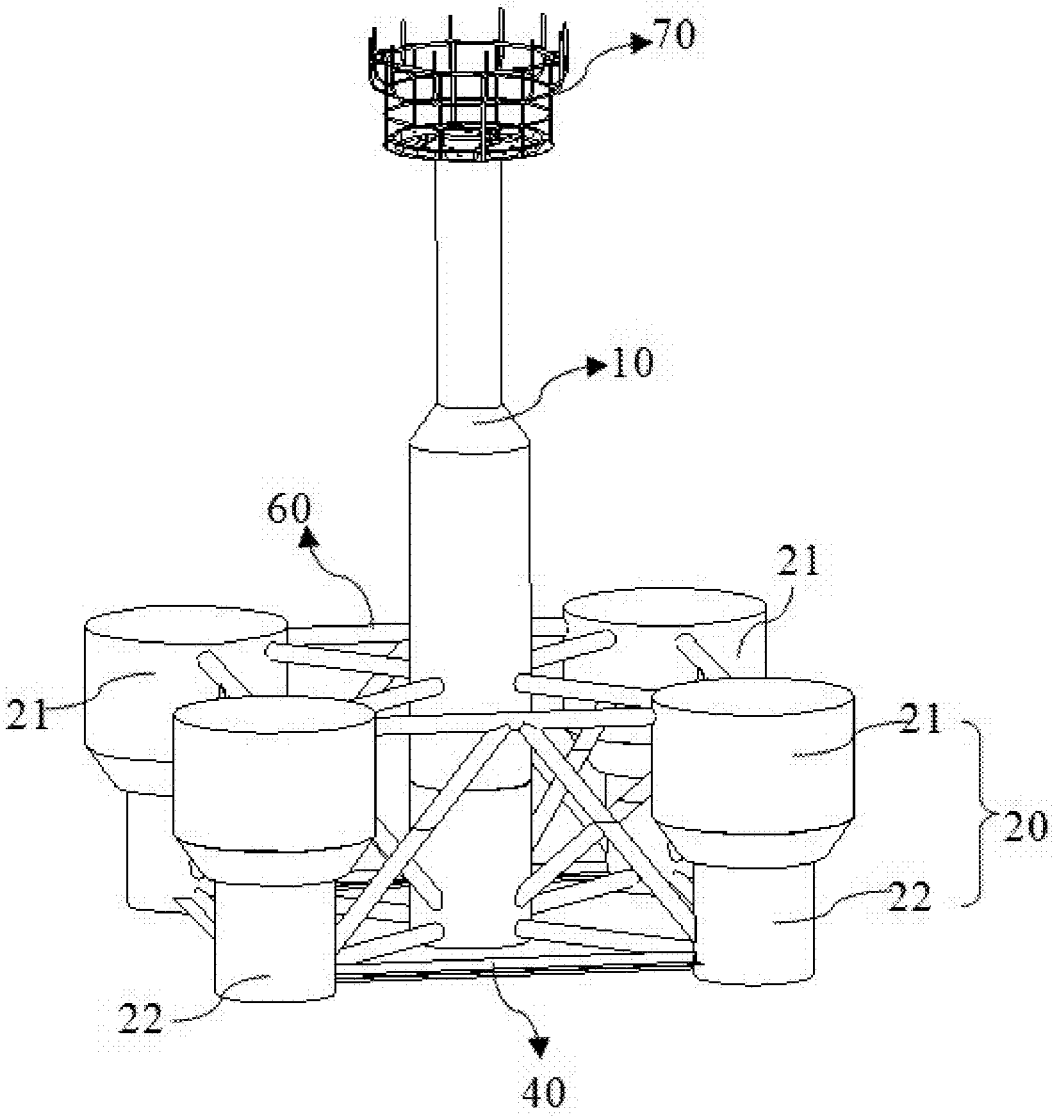
FIG. 1 is a structural schematic diagram of an embodiment of the high-stability deep-sea buoy platform of the present invention.
Figure 2:
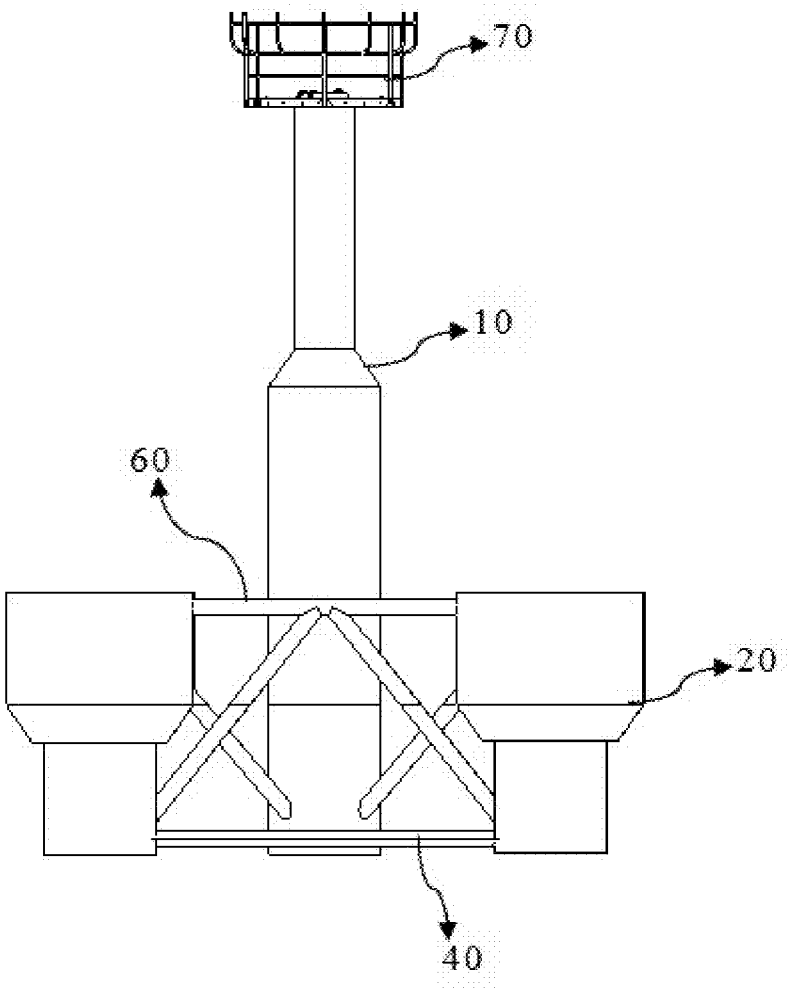
FIG. 2 is a front view of an embodiment of the high-stability deep-sea buoy platform of the present invention.
Figure 3:
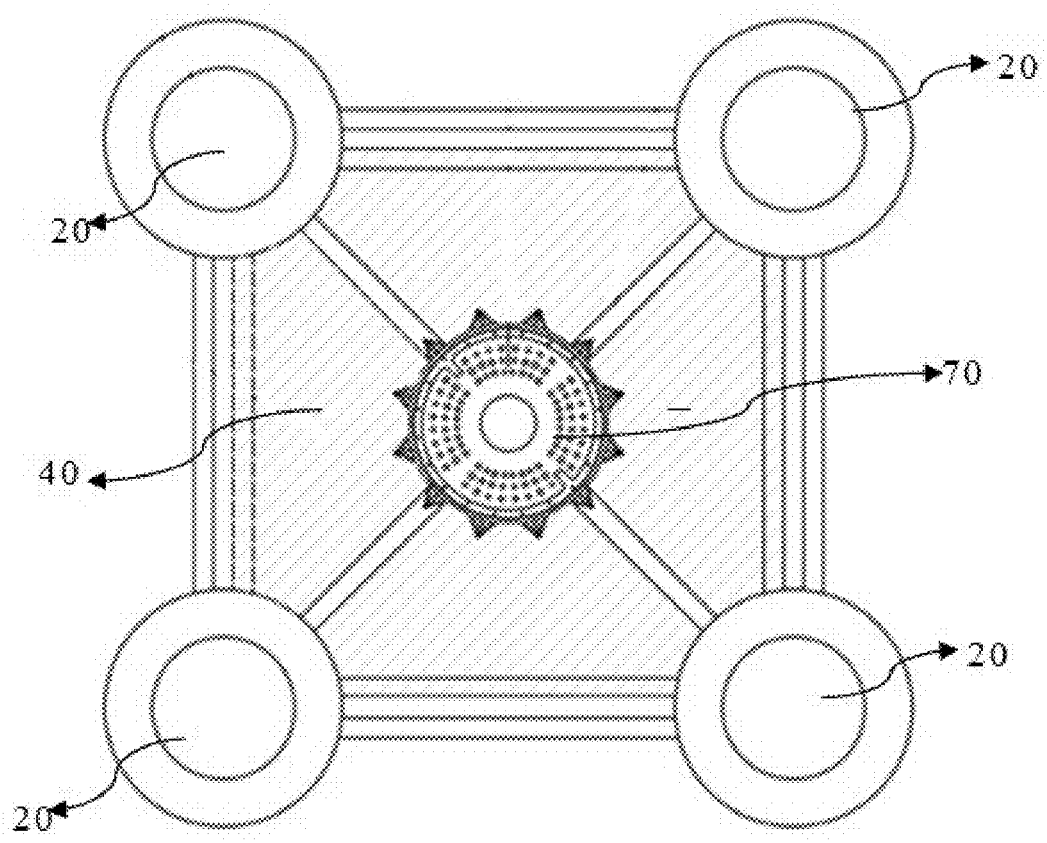
FIG. 3 is a top view of an embodiment of the high-stability deep-sea buoy platform of the present invention.
Figure 4:
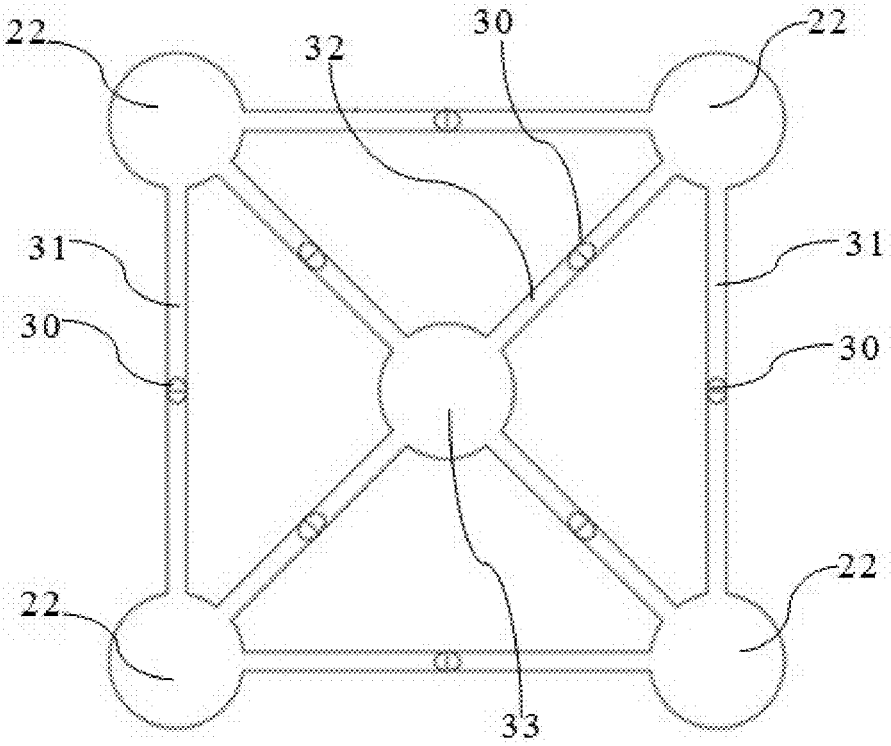
FIG. 4 is a partial top view of the structure of an embodiment of the high-stability deep-sea buoy platform of the present invention.
Figure 5:
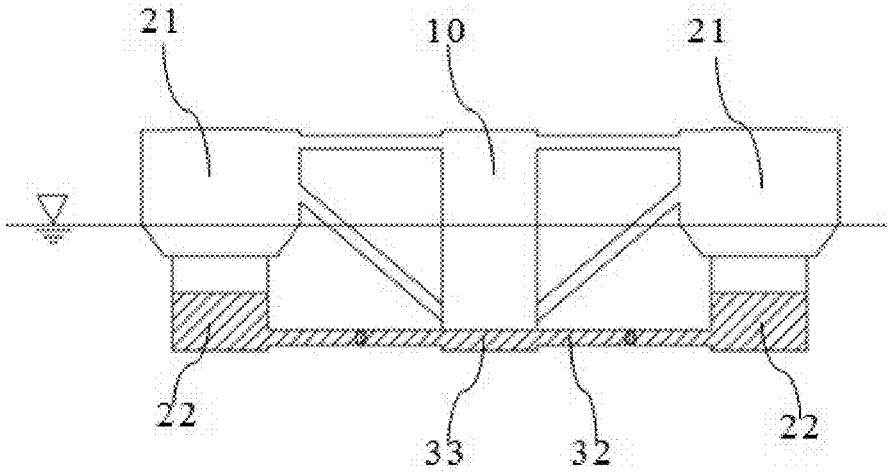
FIG. 5 is a partial cross-sectional view of the structure of an embodiment of the high-stability deep-sea buoy platform of the present invention.
Figure 6:
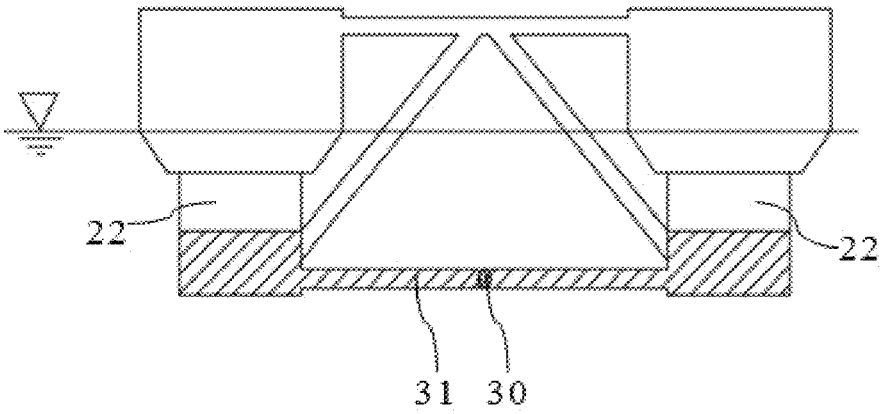
FIG. 6 is a partial cross-sectional view of the structure of an embodiment of the high-stability deep-sea buoy platform of the present invention.

To make the objectives, technical solutions, and advantages of the present invention clearer, the following description will be given in conjunction with the accompanying drawings and embodiments.

As shown in FIG. 1 to FIG. 9, a high-stability deep-sea buoy platform disclosed by the present invention includes a mast tube 10, which houses an attitude sensor used to monitor the tilt angle of the deep-sea buoy platform; a plurality of buoyancy tubes 20 that are symmetrically and equally spaced around the mast tube 10; each buoyancy tube 20 includes an elastic float 21 and a water tank 22, with the cross-section of the elastic float 21 being ring-shaped, and the elastic float 21 being fitted around the outer side of the upper part of the water tank 22; the water tank 22 is cylindrical and the interior of the water tank is divided into an upper layer and a lower layer, and the lower layer containing ballast water; each water tank 22 is connected to the other water tanks 22 via pipelines, each of the pipelines equipped with a flow valve 30; a damping plate 40 is horizontally connected between the bottoms of adjacent water tanks 22.

The deep-sea buoy platform of the present invention has strong resistance to wind, waves and currents, and the swaying amplitude due to wind, waves and currents is small, providing high stability, making it suitable for use in complex environments and harsh sea conditions in deep-sea areas.

The buoyancy tubes 20 are symmetrically and equally spaced around the mast tube 10. This distributed, symmetrical arrangement of buoyancy tubes 20 greatly reduces the flow resistance area and the wave-facing area, and the impact of waves and currents on the deep-sea buoy platform and improves the ability of the platform to withstand wind, waves, and currents. Additionally, it ensures even force distribution on the platform in deep-sea environments, improving the overall structural stability of the buoy platform.

In the present embodiment, the height of the mast tube 10 is 2 to 5 times the height of the buoyancy tube 20, with the bottom of the water tank 22 being approximately level with the bottom of the mast tube 10, facilitating the processing and assembly of the deep-sea buoy platform, as well as its deployment and maintenance.

In a vertical state, the lower part of the water tank 22 and the bottom of the mast tube 10 are submerged in water, with the elastic float 21 and the upper part of the mast tube 10 exposed above the water surface. Therefore, compared to disc-shaped buoys (the diameter of the inscribed circle of the multiple buoyancy tubes 20 is basically the same as the outer diameter of the circular disc-shaped buoy), the displacement of the buoy platform of the present invention is significantly reduced, and the size of the anchoring system required for the buoy platform is greatly diminished, reducing the difficulty of deploying the buoy platform in deep and remote seas and lowering the cost of the anchoring system.

The material density of the elastic float 21 is less than water, and the elastic float 21 can provide the main residual buoyancy for the buoy platform while also improving collision resistance, protecting the water tank 22, the mast tube 10, and the equipment installed inside.

The damping plate 40 can increase the motion damping and added inertial mass of the buoy platform, effectively reducing the platform's sway and heave, thereby decreasing the swing amplitude of the buoy platform with the wind, waves and currents. The damping plate 40 can be made of CCSB-grade marine steel, which has good corrosion resistance and a long service life.

The high-stability deep-sea buoy platform of the present invention also includes a control system. The control system is used to control the valve opening of the flow valve 30 based on the tilt angle of the deep-sea buoy platform monitored by the attitude sensor.

Ballast water is located at the bottom of the water tank 22, lowering the center of gravity height of the buoyancy tube 20. The elastic float 21 is located at the top of the water tank 22, raising the buoyancy center height of the buoyancy tube 20. The elastic float 21 and the ballast water inside the water tank 22 work together to form a tumble doll structure, enhancing the restoring torque of the buoyancy tube 20, thereby improving the deep-sea buoy platform's ability to resist wind, waves and currents, making the entire buoy platform more suitable for use in harsh deep-sea conditions.

In a vertical stationary state, the volume of ballast water in the water tank 22 is less than or equal to half of the volume of the water tank 22. This ensures that the ballast water and the elastic float 21 can effectively cooperate, significantly improving the restoring torque of the buoyancy tube 20 and the buoy platform's ability to resist wind, waves and currents.

The specific volume of ballast water in the water tank 22 can be set according to actual requirements and is not specifically limited here.

The number of buoyancy tubes 20 is preferably an even number. In the present embodiment, the number of buoyancy tubes 20 is four, with corresponding numbers of elastic floats 21 and water tanks 22 being four. Each water tank 22 is connected to the other three water tanks 22 via the pipelines.

In other preferred embodiments, the number of buoyancy tubes 20 can be three, six, or other numbers, without specific limitation here.

In the present embodiment, the pipelines include four first pipelines 31 forming a square, and two vertical and connected second pipelines 32. The first pipelines 31 are used to connect two water tanks 22 on the same side, while the second pipelines 32 are used to connect two water tanks 22 on opposite corners.

The flow valves 30 are installed in all four first pipelines 31 and two second pipelines 32. The flow valves 30 can adjust the amount and speed of the ballast water flowing through the pipelines.

In the present embodiment, a sealed connection chamber 33 is located at the intersection of the two second pipelines 32. The connection chamber 33 is connected to the four water tanks 22 via the two second pipelines 32. The connection chamber 33 is substantially in the same plane as the second pipelines 32, ensuring smooth flow of the ballast water.

The connection chamber 33 is located at the bottom of the mast tube 10 and is separated from other compartments of the mast tube 10 by watertight bulkheads. The watertight method can be any common method used in this technical field and is not specifically limited here.

The material of the first pipeline 31 and the second pipeline 32 can be CCSB-grade marine steel, which has good corrosion resistance and a long service life.

The inner diameter of the elastic float 21 is equal to the outer diameter of the water tank 22, ensuring that the size of the elastic float 21 and the volume of ballast water inside the water tank 22 complement each other, giving the deep-sea buoy platform an appropriate draft depth in the water.

The material density of the elastic float 21 is less than water, and the elastic float 21 provides the main residual buoyancy for the buoy platform. It also enhances collision resistance, protecting the water tank 22, the mast tube 10, and the equipment installed inside.

The material of the elastic float 21 can be EVA rubber-plastic foam material, with the surface of EVA sprayed with polyurea wear-resistant coating. This material has the advantages of high elasticity, impact resistance, and water resistance, giving the elastic float 21 effective buoyancy and collision resistance, as well as a long service life.

The elastic float 21 is fitted on the outside of the water tank 22. The method of fitting the elastic float 21 on the outside of the water tank 22 is any common fixing method in this technical field and is not specifically limited here.

The vertical length of the elastic float 21 is less than the vertical length of the water tank 22, and the top surface of the elastic float 21 is flush with the top surface of the water tank 22.

The material of the water tank 22 is steel, providing a stable and reliable structure with a long service life. The upper part of the water tank 22 is also equipped with lifting lugs and mooring bollards, facilitating the lifting and mooring of the buoy. The bottom of the water tank 22 is equipped with transverse pad eye, used as an underwater towing point when towing the buoy.

The high-stability deep-sea buoy platform of the present invention also includes a connecting frame 60. The connecting frame 60 is used to connect the four buoyancy tubes 20 and to connect the four buoyancy tubes 20 to the mast tube 10. The connecting frame 60 ensures stable and reliable connections between the four buoyancy tubes 20 and securely connects the four buoyancy tubes 20 to the mast tube 10. The connecting frame 60 enhances the connection, preventing the four buoyancy tubes 20 from twisting and deforming.

The connecting frame 60 can be composed of a plurality of hollow connecting pipes. Cables can pass through these connecting pipes, achieving concealed wiring and improving the safety of the buoy platform.

The mast tube 10 is a hollow cylindrical structure. Inside the mast tube 10, from top to bottom, there are a plurality of equipment compartments for installing equipment. These compartments can house collection devices, observation devices, communication devices, power devices, attitude sensors, control systems, and so on, without specific limitations here.

A ladder and hatches (not shown in the figures) are fixed to the inner wall of the mast tube 10, allowing personnel to enter and exit the mast tube 10 conveniently.

Pad eye (not shown in the figures) is provided at the bottom of the mast tube 10, which can be connected to the mooring ropes.

An instrument platform 70 is installed at the top of the mast tube 10. The instrument platform 70 is equipped with observation devices, including but not limited to meteorological observation devices.

The top of the mast tube 10 is equipped with an openable and closable hatch cover. The open hatch cover allows communication between the instrument platform 70 and the interior of the mast tube 10.

The instrument platform 70 is equipped with solar power supply equipment. The solar power supply equipment can provide power for the high-stability deep-sea buoy platform of the present invention. The solar power supply equipment can be any common solar power supply equipment in this technical field and is not specifically limited here.

The connecting frame 60 is equipped with a deck platform. The deck platform is made of grating panels, covering the gaps between the mast tube 10 and the buoyancy tubes 20, facilitating personnel operations on the buoy. The deck platform is surrounded by guardrails and is equipped with a derrick for water body observation.

The side where two water tanks 22 on the same edge are located is defined as the first side, and the side corresponding to the first side where the other two water tanks 22 are located is defined as the second side. The first side can be the right side, and the second side can be the left side; or the first side can be the left side, and the second side can be the right side, without specific limitations here. In the present embodiment, the first side is described as the right side and the second side as the left side for illustration purposes.

The attitude sensor can be installed at the center of gravity position inside the mast tube 10, which can improve the accuracy of tilt angle detection. The attitude sensor can be any common attitude sensor in this technical field and is not specifically limited here.

During the swinging and tilting process of the buoy platform, the attitude sensor can monitor the tilt angle of the deep-sea buoy platform. The flow valve 30 can adjust the flow rate and flow speed of the ballast water in the pipeline based on the tilt angle, thereby reducing the swing and tilt amplitude of the buoy platform.

Figure 7:
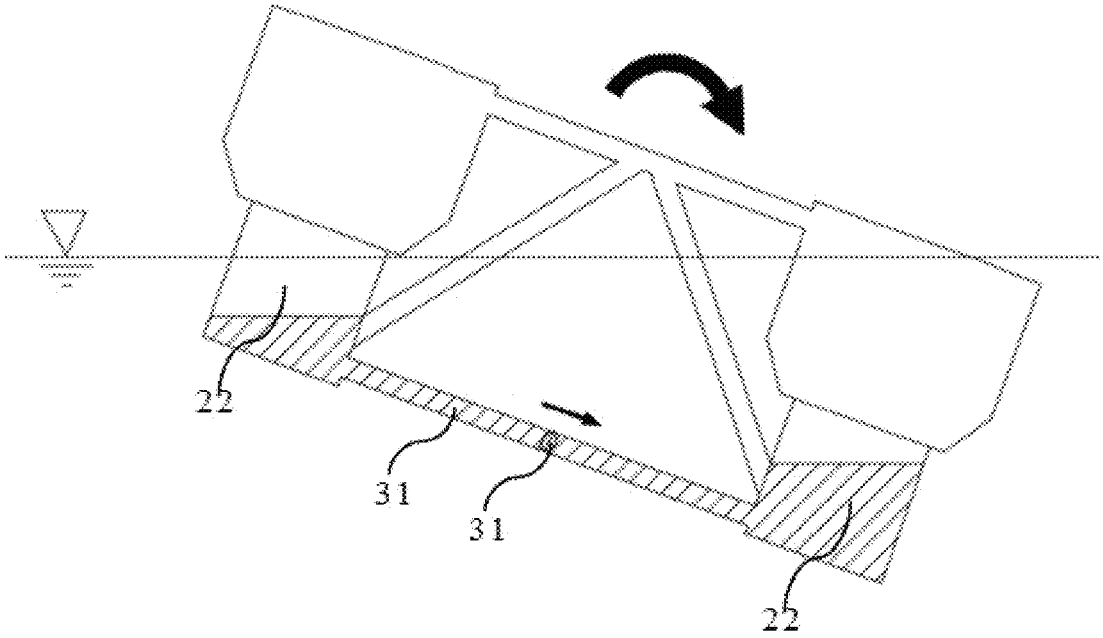
FIG. 7 is a partial cross-sectional view of the structure during oscillation of an embodiment of the high-stability deep-sea buoy platform of the present invention.

A method for controlling the oscillation of the high-stability deep-sea buoy platform according to the present invention includes the following steps:

As shown in FIG. 7, a first stage includes: under the influence of its own gravity, buoyancy, and wind, waves and currents, the deep-sea buoy platform sways from a vertical stationary state to a titled position on the right side. During this process, the ballast water in the two water tanks 22 on the left side flows through the first pipelines 31 into the two water tanks 22 on the right side in a tilted manner. When the attitude sensor detects an increase in the tilt angle of the deep-sea buoy platform, it sends a signal to the control system. The control system then reduces the opening of the flow valves 30, decreasing the volume and speed of the ballast water flowing through the first pipelines 31, thereby allowing the ballast water to flow into the water tanks 22 on the right side as slowly and in as small a quantity as possible and reducing the swaying amplitude of the deep-sea buoy platform towards the right side.

Figure 8:
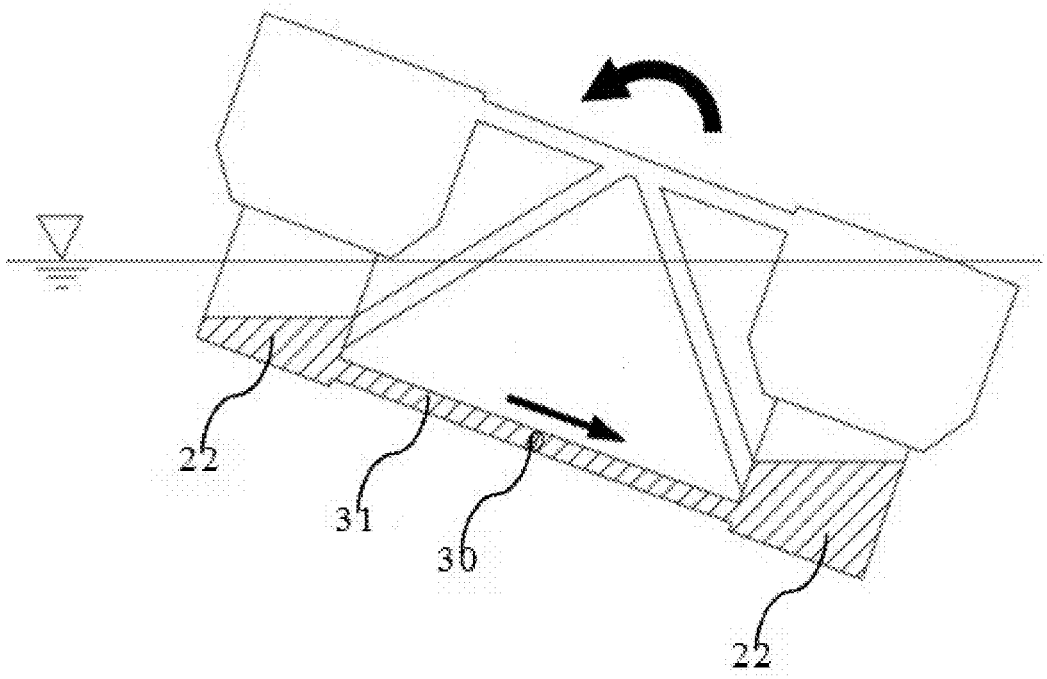
FIG. 8 is a partial cross-sectional view of the structure during oscillation of an embodiment of the high-stability deep-sea buoy platform of the present invention.
Figure 9:
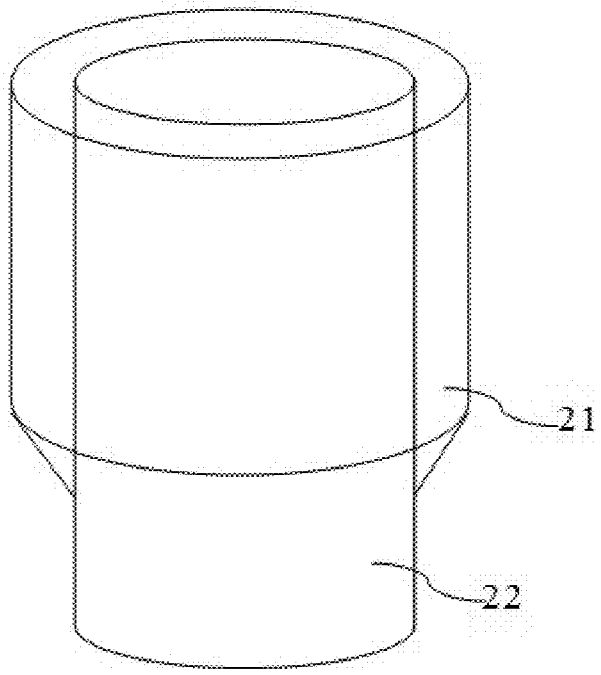
FIG. 9 is a structural schematic diagram of an embodiment of the buoyancy tube of the high-stability deep-sea buoy platform of the present invention.

As shown in FIG. 8, a second stage includes: under the influence of its own gravity, buoyancy, and wind, waves and currents, the deep-sea buoy platform can sway back from the maximum tilt angle towards the left side to a vertical state. During this process, the water tanks 22 on the left side are still higher than the water tank 22 on the right side, and the ballast water inside the two water tanks 22 on the left side flows through the first pipelines 31 towards the two water tank 22 on the right side in a titled manner. When the attitude sensor detects a decrease in the tilt angle of the deep-sea buoy platform, it sends a signal to the control system. The control system then increases the opening of the flow valves, increasing the volume and speed of the ballast water flowing through the first pipelines 31, thereby allowing the ballast water to flow into the water tanks 22 on the right side as quickly and in as large a quantity as possible and reducing the swaying amplitude of the deep-sea buoy platform towards the left side. While returning to its original position, it can also reduce the maximum swaying tilt angle in the next stage.

A third stage includes: under the influence of its own gravity, buoyancy, and wind, waves and currents, the deep-sea buoy platform sways from a vertical stationary state to a titled position on the left side. During this process, the ballast water in the two water tanks 22 on the right side flows through the first pipelines 31 into the two water tanks 22 on the left side in a tilted manner. When the attitude sensor detects an increase in the tilt angle of the deep-sea buoy platform, it sends a signal to the control system. The control system then reduces the opening of the flow valves 30, decreasing the volume and speed of the ballast water flowing through the first pipelines 31, thereby allowing the ballast water to flow into the water tanks 22 on the left side as slowly and in as small a quantity as possible and reducing the swaying amplitude of the deep-sea buoy platform towards the left side.

A fourth stage includes: under the influence of its own gravity, buoyancy, and wind, waves and currents, the deep-sea buoy platform can sway back from the maximum tilt angle towards the right side to a vertical state. During this process, the water tanks 22 on the right side are still higher than the water tank 22 on the left side, and the ballast water inside the two water tanks 22 on the right side flows through the first pipelines 31 towards the two water tank 22 on the left side in a titled manner. When the attitude sensor detects a decrease in the tilt angle of the deep-sea buoy platform, it sends a signal to the control system. The control system then increases the opening of the flow valves, increasing the volume and speed of the ballast water flowing through the first pipelines 31, thereby allowing the ballast water to flow into the water tanks 22 on the left side as quickly and in as large a quantity as possible and reducing the swaying amplitude of the deep-sea buoy platform towards the left side. While returning to its original position, it can also reduce the maximum swaying tilt angle in the next stage.

After the above four stages, the buoy platform completes one cycle of swaying motion and repeats the process. Through the above control process, the periodic flow of ballast water always lags behind the swaying motion of the buoy by approximately one-quarter of a phase. This allows for the optimal anti-sway effect, maximally reducing the swaying amplitude of the buoy platform and improving its stability.

The control methods for the swaying motion of the buoy platform in other directions are consistent with the above process and will not be elaborated upon here.

The above embodiments are only used to illustrate the technical solutions of the present invention, not to limit them. Although the present invention has been described in detail with reference to the aforementioned embodiments, those skilled in the art can still modify the technical solutions described in the aforementioned embodiments or make equivalent replacements for some technical features; these modifications or replacements do not deviate from the spirit and scope of the technical solutions of the present invention.

What is claimed is:

1. An oscillation control method for a high-stability deep-sea buoy platform, wherein the high-stability deep-sea buoy platform comprises:

a mast tube housing an attitude sensor used to monitor a tilt angle of the deep-sea buoy platform;

a plurality of buoyancy tubes symmetrically and equally spaced around a mast tube; the buoyancy tube comprising an elastic float and a water tank; a cross-section of the elastic float is ring-shaped; the elastic float being fitted around an outer side of an upper part of the water tank;

the water tank is cylindrical and an interior of the water tank is divided into an upper layer and a lower layer, and the lower layer containing ballast water;

each water tank is connected to other water tanks via pipelines, each of the pipelines equipped with a flow valve; and a damping plate is horizontally connected between bottoms of adjacent water tanks;

wherein in a vertical stationary state, the volume of ballast water in the water tank is less than or equal to half of the volume of the water tank;

the height of the mast tube is 2 to 5 times the height of the buoyancy tube;

wherein the number of buoyancy tubes is four and corresponding numbers of elastic floats and water tanks is four; each water tank is connected to the other three water tanks via the pipelines: the pipelines include four first pipelines forming a square, and two vertical and connected second pipelines; the first pipelines are used to connect two water tanks on the same side, and the second pipelines are used to connect two water tanks on opposite corners; a connection chamber is located at an intersection of the two second pipelines: the connection chamber is connected to the four water tanks via the two second pipelines;

wherein the high-stability deep-sea buoy platform further comprises a control system, which is used to control a valve opening of the flow valve based on the tilt angle of the deep-sea buoy platform monitored by the attitude sensor:

the oscillation control method for the high-stability deep-sea buoy platform comprising:

defining a side where two water tanks on the same edge are located as a first side, and defining a side corresponding to the first side where the other two water tanks are located as a second side;

a first stage: the deep-sea buoy platform swaying from a vertical stationary state to a titled position on the first side; the ballast water in the two water tanks on the second side flowing through the pipelines into the two water tanks on the first side in a tilted manner: when the attitude sensor detecting an increase in the tilt angle of the deep-sea buoy platform, the attitude sensor sending a signal to the control system; the control system reducing the valve opening of the flow valves, decreasing the volume and speed of the ballast water flowing through the pipelines;

a second stage: the deep-sea buoy platform swaying back from the maximum tilt angle towards the second side to a vertical state; the ballast water inside the two water tanks on the second side flowing through the pipelines towards the two water tank on the first side in a titled manner; when the attitude sensor detecting a decrease in the tilt angle of the deep-sea buoy platform, the attitude sensor sending a signal to the control system; the control system increasing the valve opening of the flow valves, increasing the volume and speed of the ballast water flowing through the pipelines;

a third stage: the deep-sea buoy platform swaying from a vertical stationary state to a titled position on the second side; the ballast water in the two water tanks on the first side flowing through the pipelines into the two water tanks on the second side in a tilted manner; when the attitude sensor detecting an increase in the tilt angle of the deep-sea buoy platform, the attitude sensor sending a signal to the control system; the control system reduces the valve opening of the flow valves, decreasing the volume and speed of the ballast water flowing through the pipelines;

a fourth stage: the deep-sea buoy platform swaying back from the maximum tilt angle towards the first side to a vertical state; the ballast water inside the two water tanks on the first side flowing through the pipelines towards the two water tank on the second side in a titled manner: when the attitude sensor detecting a decrease in the tilt angle of the deep-sea buoy platform, the attitude sensor sending a signal to the control system; the control system increases the valve opening of the flow valves, increasing the volume and speed of the ballast water flowing through the pipelines.

2. The high-stability deep-sea buoy platform according to claim 1, further comprising a connecting frame, wherein the connecting frame is used to connect the four buoyancy tubes and to connect the four buoyancy tubes to the mast tube.

3. The high-stability deep-sea buoy platform according to claim 1, wherein the connecting frame is composed of a plurality of hollow connecting pipes; and cables are allowed to pass through the connecting pipes.

4. The high-stability deep-sea buoy platform according to claim 1, wherein an inner diameter of the elastic float is equal to an outer diameter of the water tank; and the elastic float provides buoyancy and collision protection.

* * * * *